US005461195A

United States Patent [19]

Freeman et al.

[11] Patent Number: 5,461,195

[45] Date of Patent: Oct. 24, 1995

[54] FILLED TELECOMMUNICATIONS CABLE HAVING TEMPERATURE STABLE MUTUAL CAPACITANCE

[75] Inventors: Clarence S. Freeman, Channelview; Lawrence E. Davis, Humble, both of Tex.

[73] Assignee: Waterguard Industries, Inc., Houston, Tex.

[21] Appl. No.: 151,554

[22] Filed: Nov. 12, 1993

Related U.S. Application Data

[63] Continuation-in-part of Ser. No. 792,385, Nov. 15, 1991, abandoned, which is a continuation-in-part of Ser. No. 489,211, Mar. 2, 1990, which is a continuation of Ser. No. 335,182, Apr. 7, 1989, abandoned, which is a continuation-in-part of Ser. No. 253,914, Oct. 6, 1988, abandoned, and a continuation-in-part of Ser. No. 181,833, Apr. 15, 1988, and a continuation of Ser. No. 401,563, Aug. 28, 1989, Pat. No. 5,256,705, said Ser. No. 253,914, is a continuation of Ser. No. 45,889, May 1, 1987, abandoned, said Ser. No. 45,889, and Ser. No. 181,833, each , is a continuation-in-part of Ser. No. 939,007, Dec. 8, 1986, Pat. No. 4,752,997, which is a continuation-in-part of Ser. No. 844,144, Mar. 26, 1986, Pat. No. 4,711,022.

[51] Int. Cl.[6] ..... H01B 7/28; H01B 13/06; H01B 13/32

[52] U.S. Cl. ..... 174/23 R; 156/48; 156/51; 174/23 C; 523/173

[58] Field of Search ..... 174/23 R, 23 C; 156/48, 51; 523/173

[56] References Cited

U.S. PATENT DOCUMENTS

| | | | |
|---|---|---|---|
| 3,347,974 | 10/1967 | Arendt et al. | 174/23 |
| 3,403,089 | 9/1968 | Joyce | 204/181 |
| 3,538,235 | 11/1970 | Arendt et al. | 174/23 |
| 3,683,104 | 8/1972 | Woodland et al. | 174/116 |
| 3,875,321 | 4/1975 | Bopp et al. | 174/23 C |
| 3,893,961 | 7/1975 | Walton et al. | 206/23 H |

(List continued on next page.)

FOREIGN PATENT DOCUMENTS

| | | | |
|---|---|---|---|
| 0013477A1 | 7/1980 | European Pat. Off. . | |
| 0031789A1 | 1/1981 | European Pat. Off. . | |
| 0353251B1 | 12/1992 | European Pat. Off. . | |
| 1473753 | 3/1967 | France . | |
| 1690095 | 2/1971 | Germany . | |
| 1936872 | 3/1971 | Germany . | |
| 2216139 | 10/1973 | Germany . | |
| 2951722A1 | 7/1981 | Germany . | |
| 3128779A1 | 4/1982 | Germany . | |
| 3048912 | 7/1982 | Germany | 174/23 C |
| 28164 | 7/1980 | Japan | 174/23 C |
| 1200395 | 7/1970 | United Kingdom . | |
| 2080998 | 2/1982 | United Kingdom . | |
| 2100281 | 12/1982 | United Kingdom | 174/23 C |
| WO8808440 | 11/1988 | WIPO . | |

OTHER PUBLICATIONS

D. M. Mitchell and R. Sabia, *Development, Characterization, and Performance of an Improved Cable Filling Compound,* International Wire & Cable Symposium Proceedings 15 (1980).

W. Englehart, et al., "An Analysis of Field Performance of Cellular Insulated Filled Telephone Cable After a Decade of Service," 1986 International Cable and Wire Symposium Proceedings 252 (1986).

L. E. Davis, et al., "A New Low Dielectric Constant Filling Compound for Telecommunications Cable," 1980 International Wire and Cable Symposium Proceedings 39 (1980).

(List continued on next page.)

*Primary Examiner*—Morris H. Nimmo
*Attorney, Agent, or Firm*—Vaden, Eickenroht, Thompson & Feather

[57] ABSTRACT

A cable having a thixotropic filling compound therein, the filling compound being a gel composition including a water absorbent hydrocarbon polymer with pendent anionic groups. The composition eliminates shorts caused by moisture contact with such wires. The cable including the composition is stabilized against thermally induced capacitance changes and shows improved oxidation induction times.

17 Claims, 3 Drawing Sheets

OTHER PUBLICATIONS

M. Tenzer, et al. "Analysis of Long Term Stability of Expanded Insulations in Filled Cables," 1979 International Cable and Wire Symposium Proceedings 244 (1979).

J. P. Garmon, et al., "A Comparison of the Properties of Foam and Foam–Skin Insulation in Filled Cables," 1979 International Cable and Wire Symposium Proceedings 232 (1979).

D. Mangaraj, et al., "The Effect of Filling Compound Migration on Cellular Insulation," 1979 International Cable and Wire Symposium Proceedings 139 (1979).

C. K. Eoll, "The Aging of Filled Cable with Cellular Insulation," 1978 International Cable and Wire Symposium Proceedings 156 (1978).

S. G. Foord, "Compatibility Problems in Filled Cellular Polyolefin Insulated Telephone Cables," 1973 International Cable and Wire Symposium Proceedings 23 (1973).

S. Verne, et al., "Long–Term Stability of Fully–Filled Cables," 1973 International Cable and Wire Symposium Proceedings 244 (1973).

S.I.R. H624, Handlin, Jr., et al., published Apr. 4, 1989.

U.S. Re. 30,715, Woytiuk, reissued Aug. 18, 1981.

A. C. Levy, et al., "Properties of Water Absorbent Gels Formulated for Use as Filling Compounds for Copper Telecommunications Cable and as Splice Case Encapsulants," 1992 International Wire and Cable Symposium Proceedings (1992).

S. C. Welch, et al., "A New Technology for Waterproof Telecommunications Cable and Splice Systems," 1990 International Wire and Cable Symposium Proceedings (1990).

D. M. Mitchell, "The Effect of Filling Compound on the Capacitance of Foam–Skin Insulation," 1988 International Wire and Cable Symposium Proceedings 500 (1988).

A. W. Stratton, et al., "A Comparative Study Related to the Performance of PE/PJ and ETPR Filling Compounds,"International Cable and Wire Symposium Proceedings 222 (1987).

U.S. PATENT DOCUMENTS

| | | | |
|---|---|---|---|
| 3,893,962 | 7/1975 | Walton et al. | 260/28.5 |
| 3,996,413 | 12/1976 | Foord et al. | 174/23 C |
| 4,002,819 | 1/1977 | Woytiuk | 174/23 |
| 4,004,077 | 1/1977 | Woytiuk | 174/23 |
| 4,308,416 | 12/1981 | Herman et al. | 174/23 |
| 4,333,706 | 6/1982 | Davis et al. | 174/23 C |
| 4,366,075 | 12/1982 | Beach | 252/28 |
| 4,366,284 | 12/1982 | Ishido et al. | 524/447 |
| 4,370,023 | 1/1983 | Lange et al. | 350/96 |
| 4,388,485 | 6/1983 | Zeidler et al. | 174/23 C |
| 4,551,569 | 11/1985 | Verne | 174/23 C |
| 4,563,540 | 1/1986 | Bohannon, Jr. et al. | 174/23 R |
| 4,701,016 | 10/1987 | Gartside, III et al. | 350/96 |
| 4,703,132 | 10/1987 | Marciano-Agostinelli et al. | 174/23 |
| 4,711,022 | 12/1987 | Feeman et al. | 29/825 |
| 4,721,832 | 1/1988 | Toy | 174/87 |
| 4,752,997 | 6/1988 | Freeman et al. | 29/402.18 |
| 4,870,117 | 9/1989 | Levy | 523/173 |
| 5,256,705 | 10/1993 | Freeman | 523/173 |

FILLED TELECOMMUNICATIONS CABLE HAVING TEMPERATURE STABLE MUTUAL CAPACITANCE

This patent application is a continuation-in-part of patent application Ser. No. 07/792,385, filed on Nov. 15, 1991, now abandoned and entitled FILLED CABLE AND METHOD. Application Ser. No. 07/792,385 is itself a continuation-in-part of pending application Ser. No. 07/489,211, filed on Mar. 2, 1990, entitled COMPOSITION FOR PROTECTING THE CONTENTS OF AN ENCLOSED SPACE FROM DAMAGE BY INVASIVE WATER, which is a continuation of application Ser. No. 07/335,182 of that same title, filed on Apr. 7, 1989 and now abandoned. Application Ser. No. 07/335,182 is a continuation-in-part of applications Serial No. 07/253,914 (now abandoned), entitled COMPOSITION FOR PROTECTING COMMUNICATION WIRES, filed on Oct. 6, 1988, and Ser. No. 07/181,833, entitled COMPOSITION WITH TACKIFIER FOR PROTECTING COMMUNICATION WIRES, filed on Apr. 15, 1988, and a continuation application of Ser. No. 401,563 filed Aug. 28, 1989 and now issued as U.S. Pat. No. 5,256,705. Ser. No. 07/253,914 is a continuation of application Ser. No. 07/045,889, having that same title, which was filed on May 1, 1987, and which is now abandoned. Both application Ser. Nos. 07/045,889 and 07/181,833 are continuation-in-part applications of Ser. No. 06/939,007, filed Dec. 8, 1986, entitled PROCESS OF REPAIRING A MULTI-WIRE ELECTRICAL CABLE and issued as U.S. Pat. No. 4,752,997, which is in turn a continuation-in-part of application Ser. No. 06/844,144, now issued U.S. Pat. No. 4,711,022, filed Mar. 26, 1986, entitled METHOD FOR WIRE INSULATION.

BACKGROUND OF THE INVENTION

1. Field of the Invention

This invention is for a cable filled with a gel chemical composition that, when exposed to changes in ambient temperature, substantially maintains its nominal mutual capacitance. The composition is a water absorbent thixotropic gel (ATG) that is activated by moisture to absorb water and yet can be used to protect components from water damage.

The composition is incorporated into the cable, either between conductors in a bundle and/or between the bundles of conductors contained in, for instance, a telecommunications cable. Regardless of the use of the cable, not only does the composition prevent the entry of water, but the composition also eliminates electrical shorts caused by water contact with the conductors in cables, such as telephone cables, which carry a small direct current, thereby attenuating the short and restoring full current flow through the conductors.

2. Description of the Prior Art

Communications cables such as telephone lines are made up of a multitude of pairs of conducting wires, typically copper wire, which are insulated from each other with a thin layer of a thermoplastic resin and bundled by an insulating material. Bundles of insulated pairs of conducting wires are then wrapped with a sheath of plastic, paper wrapping or other material, into a cable. A filler such as a petroleum gel is added to many cables inside the cable cover to fill the interstitial spaces and retard water migration therein.

In recognition of the essential nature of the ability of telecommunications cable to be able to withstand exposure to water, the industry has promulgated certain performance standards which the cable must achieve. In particular, one standard requires that a three foot long section of cable not pass water when maintained under a column of water three feet high (e.g., a "three foot water head"). The industry is currently considering a change in that standard to require that a section of cable eight feet long not pass water when subjected to twelve feet of water head for twenty four hours.

As noted above, the prior art discloses protection of telecommunications cable against water invasion by filling the spaces between the wrapped bundles of conducting wires inside the cable (referred to as the filling zone) with compounds such as polyethylene-petroleum jelly (PEPJ) and oil-extended thermoplastic rubbers (ETPR), the latter being widely used by AT&T and the Bell regional operating companies in the United States and sold under the trademark FLEX-GEL. Certain patents also describe telecommunications cables including water swellable polymers such as polyvinyl alcohol, polyacrylamides, or cellulose derivatives, which are applied to bundle wrappings or contained in "moisture barriers" which are spaced internally along the length of the cable. Such cables are, however, characterized by a number of limitations and disadvantages. In the case of those which include a polymer which swells in the presence of water, the polymer is typically provided in a granular or powder form. As such, distribution of the polymer throughout the cable is problematical. If not distributed evenly throughout the cable, effective water absorbance is not assured. Further, when insufficient quantities of polymer are present, the ability of the swollen polymer to block water migration becomes problematical. Another problem is that many water-absorbent polymers, especially in the case of cellulose derivatives and other naturally-occurring polymers, are susceptible to bacterial attack, resulting in production of acids and other by-products which can damage or degrade the components of the cable.

Perhaps more importantly, on contact with water, powders alter the electrical characteristics of the cable. Using smaller quantities of the powder in the cable so as to decrease that effect compromises the water blockage capabilities of the powder. Further, certain swelling agents such as polyvinyl alcohols and polyacrylamides do not swell quickly enough in cold water to effect proper water blockage when the bundle is only partially filled, while filling the bundle completely with such agents is prohibitively expensive and causes problems with swelling in the confined space when contacted by water.

ETPR filling compounds are also characterized by a number of disadvantages and/or limitations. For instance, ETPRs must be heated to achieve a liquid state for handling and filling of the cable, increasing cost and creating logistical problems during storage and transport of the material. Cable is filled at about 230° F. and under pressure such that the filling operation is relatively dangerous and thermal contraction after filling results in the formation of voids which can serve as paths for water migration. Further, only recently have ETPRs been available which can be used in aerial cables; the temperatures in the cable resulting from ambient temperature and exposure to sunlight caused previous ETPRs to liquify and drip out of the cable. Recently issued U.S. Pat. No. 4,870,117 is directed to a filling compound which is stated to maintain its gel state at temperatures up to 80° C. (e.g., the temperature to which aerial cables may be subjected), but reports from the field indicate that such cables may not be performing as expected. Further, so far as is known, cable including this material cannot meet the proposed 12 feet/24 hour industry standard for resistance to water penetration.

Another problem with the use of ETPRs which has recently come to light is the cracking of the foam-skin polyethylene used to insulate the wires of the ETPR-filled cable. See, for instance, T. N. Bowmer, "Cracking of Foam-Skin Polyethylene Insulation in Pedestals, " Proceed. 37th Int. Wire & Cable Symp. 475 (1988). The response of the industry to this problem was to increase anti-oxidation stabilizer content to obtain improved foam-skin life expectancy. That approach, however, does not address the fundamental issue of the compatibility (or incompatibility) of the resin, stabilizer(s) and/or filling compounds.

Petroleum gels are generally used as filling compounds, in part because all known substitutes suffer from one or more disadvantages which limit their utility such that petroleum gels represent the least expensive alternative. However, petroleum gels are generally characterized by many of the same disadvantages of ETPRs.

In short, in spite of a continuing and long-felt need, and in spite of the many attempts which have been made to solve these problems, there is still a need for a water resistant cable, and further, for a filled cable having stable capacitance relative to temperature change and which is less susceptible to the effects of long term aging. The ideal cable would maintain constant electrical parameters regardless of the ambient conditions such as temperature or the presence or absence of moisture and as the cable ages.

SUMMARY OF THE INVENTION

This need is met by providing a telecommunications cable having a relatively temperature stable mutual capacitance wherein the space between the wires of the cable are filled with a filling compound comprising a gel matrix having a water absorbent polymer dispersed therein and thickened by a thixotropic agent to form a gel having a dielectric constant which increases as the temperature to which the cable is exposed increases.

Also provided is a method of making a telecommunications cable having polyethylene-insulated wires therein comprising the steps of (a) injecting a filling compound comprised of a gel matrix, a water absorbing polymer, and a thixotropic agent into a die; (b) drawing a polyethylene insulated wire through the filling compound in the die to coat the wire with the filling compound at room temperature; and (c) wrapping the coated wire of step (b), together with an additional wire coated with the filling compound in the manner set out in steps (a) and (b), into a telecommunications cable.

DESCRIPTION OF THE PREFERRED EMBODIMENTS

Figure 1:
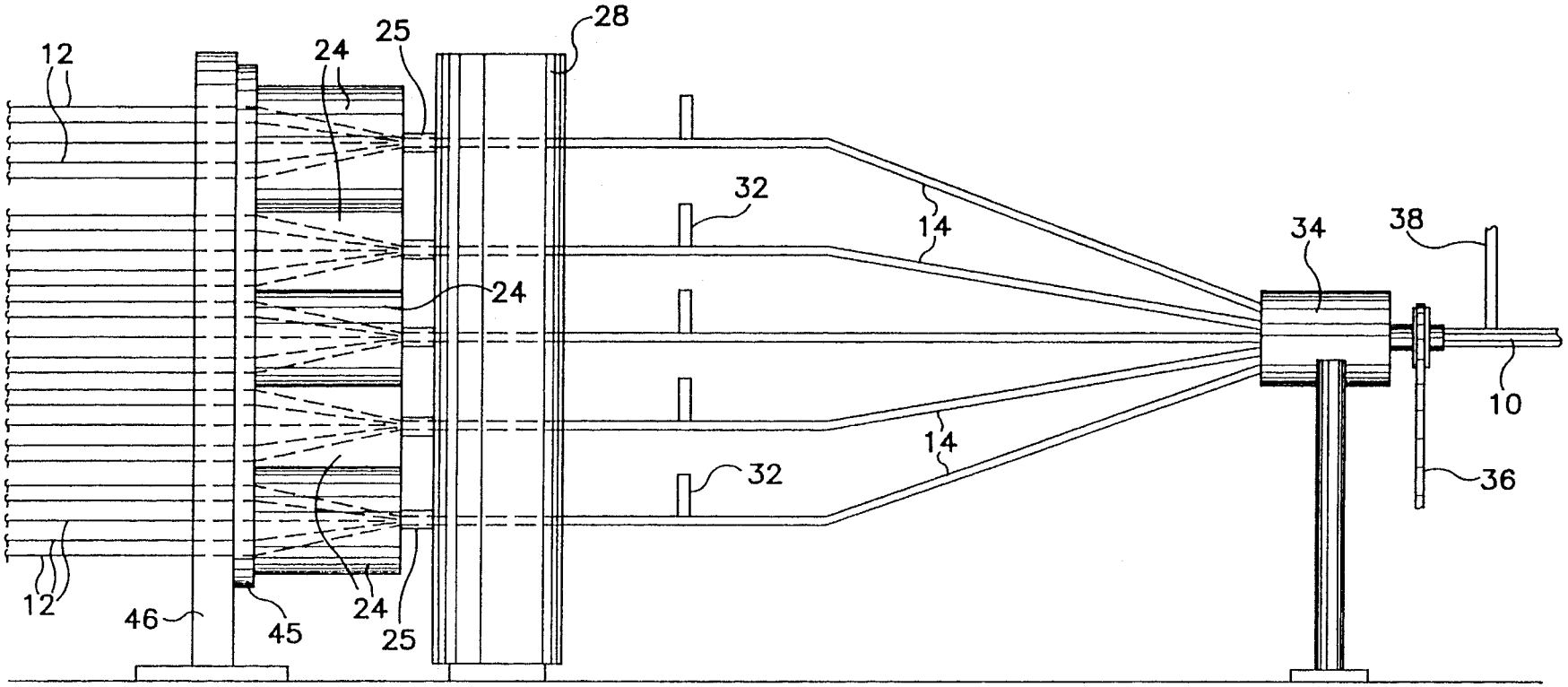
FIG. 1 is a schematic representation of a method for making a telecommunications cable including the composition of the present invention.

The telecommunications cable of the present invention includes a water absorbent thixotropic gel composition which provides an initial barrier to the entry of water into the area of the cable in which the composition is located. If water does enter the space, the water absorbent polymer in the gel is activated and the water is absorbed. In tests, water was placed adjacent to the gel composition. The fine powder-like polymer in the dielectric gel matrix is seen traveling to the water within the gel matrix. This effect appears to be the result of the water absorbent polymer seeking out the water. Once the water contacts the dielectric gel, a highly viscous semi-solid material is formed by migration of the polymer from out of the gel that, depending on the distance from the dielectric gel composition, is incapable of fluid movement and which restricts movement of the water to extremely slow, diffusion-controlled movement.

The water absorbent polymers, having pendent anionic groups, when exposed to a wire that is in short caused by the presence of water, causes an attraction of the anionic groups of the polymer to the wire, the wires acting, in effect, as an anode. This apparent attraction of the polymer to the exposed wire brings the polymer into electrochemical association with the wire, and the accumulated polymer that develops around the exposed wire excludes water from the surface of the wire. As that layer builds up around the wire, the short is attenuated and full flow of current through the wire is re-established with the result that the short is eliminated or "healed". Depending on the components of the gel and the size of the flaw in the insulation, the healing process can take as short a time as several minutes up to about 2 or 3 hours, after which current is re-established through the wire.

The gel filling the cable of the present invention therefore plays several roles in protecting the electrical conductors of a telephone cable from moisture damage. First, if there is invasive moisture, the gel composition repels the water. Additionally, in the presence of moisture, the water absorbent polymer of the dielectric gel is activated to travel out of the gel matrix to form a gel upon contact with the water. This traveling effect is particularly useful when the confined space is in a cable containing a multitude of wires in a bundle having very small interstitial spaces therebetween. The polymer travels into the interstitial spaces if moisture is present, thereby causing the water itself to participate in a plugging effect to prevent further invasion of water into the cable. In the case of, for instance, communication cables having small (pinhole-sized) flaws in the insulation around a conductor, an additional benefit is that any shorts which are present may be healed by the gel composition, restoring current through the conductor.

The gel composition in the telecommunications cable of the present invention plays another, equally important, role in the cable. It has been shown that the oils in PEPJs and ETPRs are absorbed into the polyolefin insulation of the paired conductors in the cable. This absorption causes the insulation to swell, causing increased spacing between conductors and thereby decreasing the mutual capacitance within the cable. In addition, it has been shown that in polyolefin foam insulation, continued oil absorption causes the air spaces within the foam (cells) to become partially filled with the oil. As the cells fill with oil, the effective dielectric constant of the foam is increased, thereby increasing the mutual capacitance between the paired conductors, which affects the impedance of the cable. In addition, changes in the capacitance may affect crosstalk characteristics of the cable. The term "effective dielectric constant" refers to the composite effects of the various dielectric constants of the materials between the conductors; for example, air has a dielectric constant of one and polyethylene has a dielectric constant of about 2.2 and foamed insulation is made up of these two components and therefore has a dielectric constant between that of the two components depending upon the ratio of polyethylene to air. As the air in the cells is displaced by absorbed oil, displacing air with material having a higher dielectric constant, the effective dielectric constant is increased.

The capacitance of the cable is also affected by temperature. As temperature increases, the materials within the cable undergo thermal expansion, causing increased spacing between conductors and resulting in a decrease in capacitance. With known commercially available insulations and filling compounds, the dielectric constants of the materials are essentially constant over the operating temperature range of the cable. Therefore, in currently commercially available cables, capacitance change is a function of thermal expansion. Changes in capacitance due to temperature changes occur immediately with temperature change of the cable whereas capacitance changes due to oil absorption and/or cell filling are gradual over time (weeks to years), the rate depending upon the average temperature to which the cable is exposed. Changes due to absorption are irreversible whereas changes in capacitance due to temperature changes are cyclical as ambient temperature rises and falls.

The gel composition of the cable of the present invention, however, mitigates the change in capacitance due to the above phenomena. The oils used in formulating the composition filling the cable of the present invention are maintained in the thixotropic gel and therefore, are considerably less mobile and are not absorbed to the same extent as the oils of, for instance, PEPJs and ETPRs. Not only does the thixotrope maintain the oils in the gel, but higher molecular oils are used to further decrease mobility. The thixotropic agents of the gel composition of the cable of the present invention bind the oil into the gel and therefore do not depend exclusively on synthetic microcrystalline wax and/or rubber to prevent oil migration. Consequently, as the temperature to which the cable is exposed increases, less oil is free to migrate into the cells of the insulation. Because the thixotropic property of the gel allows the cable to be filled at ambient temperature (as compared to the increased temperatures required for ETPR- and PEPJ-filled cables), there is no initial heat soak to begin migration of oil into insulation. The result of the reduced tendency of the gel composition which fills the cable of the present invention to migrate into the polyethylene insulation prevents the gel composition from imparting additional stress to the insulation as opposed to ETPR compounds. Lower stress levels within the insulation results in reduced cracking of the insulation over time. The decreased mobility of the oil component of the gel composition also decreases the cell filling phenomena and therefore mitigates capacitance change.

An additional benefit of the decreased mobility of the oil component of the composition which fills the cable of the present invention is of particular benefit when the cable is used as aerial cable. As noted above, when PEPJ- and ETPR-filled cable cools after being filled at 230° F., small voids are left as a result of the varying degrees of thermal contraction of the components of the cable. Mobile oils in such filling compounds tend to accumulate in these voids, a process which is accelerated by the 80° C. and higher internal temperatures which aerial cable can develop. Further, the oils tend to accumulate in the voids in the lower parts of the cable, a phenomenon which can actually vary the local concentrations of the various component ingredients of the cable, affecting the electricals and exacerbating the above-described aging/cell-filling processes. Not only does the decreased mobility of the oils of the filling compound which is utilized in the cable of the present invention help avoid these problems, but there are no thermally-induced voids in which the oil accumulates since the cable is filled at ambient temperature.

The filled cable of the present invention is also characterized by another advantage which distinguishes the cable of the present invention over that filled with, for instance, ETPRs or PEPJs. The capacitance change due to changes in ambient temperature as a result of the temperature dependency of the dielectric constant of the filling compound is mitigated as a result of the inclusion of the water absorbing polymer. This temperature dependency results from a decrease in the spacing between conductors as temperature decreases. This reduction in space would be expected to cause an increase in capacitance in the case of cables filled with ETPRs or PEPJs. However, the gel composition which fills the cable of the present invention is engineered so that an increase in dielectric constant of the gel mitigates the effect of temperature. The polyolefin insulation and oil carrier of the filling compound have relatively constant dielectric constants; addition of the water absorbing polymer, which has a temperature-affected dielectric constant, has the result of maintaining an effective dielectric constant which is stable over the expected operating temperature range of the cable by offsetting, or mitigating, the changes in dielectric constant resulting from thermal expansion and/or contraction.

A 25 pair, 24 gauge telecommunications cable manufactured for Applicant by an established, domestic cable manufacturer which includes the gel composition of the present advantage has met and exceeded the above-described industry standards for cable performance. For instance, one section of such cable that is just two feet in length has withstood about fifty (50) feet of water head (simulated with 23–25 psi air pressure on water) for about twenty-four (24) months, and another section of such cable that is five feet long has withstood sixty (60) feet of water head for about twenty six (26) months without passing any water. Those experiments are on-going such that it is possible that this level of performance will continue for an indefinite, additional period of time.

The water absorbent polymers which are suitable for use in connection with the filling compound of the cable of the present invention are those with a hydrocarbon chain backbone and pendent anionic groups on the hydrocarbon chain, and are preferably polymers of non-naturally occurring monomers so as to be less susceptible to bacterial degradation. The anionic groups can be carboxylate, sulfate, phosphate, sulfonate, phosphonate, or any other anionic groups which will form a negative charge on exposure to water, polycarboxylates being preferred. The preferred carboxylate polymers are those made from α, β-ethylenically unsaturated mono- and dicarboxylic acids and/or anhydrides such as propenoic acids, α-methylpropenoic acids, β-methylpropenoic acids, maleic acids, fumaric acids and the respective maleic and fumaric anhydrides. Particular success has been achieved using a polymer of 2-propenoate commonly referred to as polyacrylic, or propenoic, acid the anionic carboxylate groups of which, when exposed to aqueous conditions, yield a strongly negative charge along the polymer chain. The salt form of these polymers can be used with a variety of ions including, but not limited to, alkali metal ions such as lithium, sodium, potassium or alkali earth metals such as magnesium, calcium, strontium, barium, zinc or aluminum. The salt used will depend on the valency of the anionic group attached to the hydrocarbon chain backbone.

Although the preferred water absorbent polymers are polycarboxylates, other superabsorbent polymers of acrylates, acrylamides, methacrylate, methacrylamide, acrylonitrile, methacrylonitrile, diacrylate, and starch graft polymers of those polymers (such as a starch-polyacrylonitrile graft polymer) may be used to advantage. Such polymers are resistant to biological degradation over a long period of time. Consequently, polymers of these non-naturally occurring monomers are collectively referred to as being "non-biodegradable" throughout this specification. For instance, the polyacrylic acid polymer described above has been demonstrated to be resistant to degradation over a period of several years; controlled experiments with that polymer have shown no degradation for over one year.

The water absorbent polymer is incorporated into the gel composition in concentrations ranging from about 5 to about 33% by weight of the final composition, depending upon the particular polymer utilized. Although satisfactory results have been obtained with compositions including concentrations of polymer at both ends of that range (hence the use of the word "about" in describing the range), concentrations of from about 6 to about 20% are preferred, and in the case of the preferred polyacrylic acid polymer, a concentration of from about 8 to about 15% is preferred.

Selection of the particular polymer, and the specific proportion of the polymer that is selected, depends upon the desired degree of change of dielectric constant in the gel composition of the cable of the present invention. In other words, different polymers affect the change in dielectric constant resulting from changes in the temperature to which the cable is exposed, as do different proportions of the polymer. It is generally desired to select a polymer (and a proportion of that polymer) which, when incorporated into the gel composition, gives a dielectric constant for that composition which ranges between about 2.2 at 25° C. up to about 2.3 at 65° C., but those skilled in the art who have the benefit of this disclosure will recognize that the type of polymer and/or its proportion may need to be modified for use in connection with, for instance, aerial cable which may reach temperatures of above 80° C. Selection of the particular polymer utilized, and the proportion of that polymer, is made by experimentation in accordance with the test described in Example 7, below. As the data set out in that Example illustrate, the preferred cable of the present invention is filled with a composition having a dielectric constant which varies by about −5.15% at −3° C. up to about +5.69% at 60° C., using 25° C. (and the approximate dielectric constant of 2.2) as the nominal "zero" point.

A number of compositions which are gels or can be thickened to form a gel have been used as a gel matrix. The gel matrix must be relatively nonconductive to a small direct current, e.g., have a low dielectric constant. The matrix should provide a fairly uniform dispersal of the anionic hydrocarbon polymer in the gel. The viscosity and composition of the gel is varied depending on the method used to introduce the composition into the telecommunications cable and the temperature and conditions under which the cable is manufactured.

The gel matrices used in this composition include silicones, petroleum gels, high viscosity esters, glycols, polyglycols, olefins and fluorocarbons. All such materials and/or mixtures are referred to collectively herein as dielectric oil gel matrices. Mixtures including napthenic and paraffinic oils are presently preferred for use as gel matrices in the composition of the present invention but those skilled in the art who have the benefit of this disclosure will recognize that any long chain, saturated oil is likewise used to advantage. Petroleum hydrocarbons must be free of impurities which could corrode the conductors in the cable.

The gel matrix is used to advantage in concentrations ranging from about 40 to about 92% by weight. The preferred concentrations, depending on the particular material, range from about 70 to about 85% by weight.

Thixotropes are used to achieve a desired viscosity. Suitable thixotropes include those known in the art for thickening petroleum oils, fluorocarbons, waxes, petrolatums, gels and greases, and can include such materials as ethylene and polyethylene microspheres. Typical thixotropes for gels and greases are pyrogenic or fumed silica (e.g., CAB-O-SIL, Cabot Corp. and AEROSIL, Degussa Corp.), organophilic clays such as bentonite (e.g., BENTOLITE, Georgia Kaolin Co. and BENTONE and BARRAGEL, N.L. Industries/Rheox) and hectorite, soaps such as metal stearates, and ureas. The amount of the thixotrope which is utilized depends upon the viscosity desired, the particular gel matrix with which the thixotrope is used, whether an extender is utilized and the specific thixotrope. Generally, the thixotrope is used in a concentration of from about 1 to about 15% of the gel by weight, with approximately 4 to 8% being the preferred concentration. For instance, if a styrene-ethylene-propylene block co-polymer is used as the extender, the preferred concentration of the thixotrope is about 5%, but concentrations of from about 1 to about 8% have been used to advantage. If microspheres of either low density polyethylene, high density polyethylene or ethylene vinyl acetate copolymer are utilized as the thixotrope in, for instance, a dielectric oil gel matrix, the preferred concentration is about 10% by weight. However, such thixotropes have been used in concentrations ranging from about 5 up to about 15% successfully. If a petroleum hydrocarbon of, for instance, aliphatic or napthenic paraffins, or a mixture of the two paraffins, is used as a gel matrix, the amount of thixotrope added ranges from about 5 to about 10%. When silica is used as a thixotrope with such oils, the concentration used is between about 4 and about 8%, the preferred concentration being about 6%.

The thixotrope is used to prepare gel compositions with desired viscosities of from about 1.2 to about 1.8 million centipoises at 25° C. To counteract the tendency of the oil component of the filled cable of the present invention to swell the insulation around the conductors and migrate into the cells, it is preferred that oils of relatively high molecular weight must be utilized. Preferably oils having a molecular weight of between about 400 and about 1000 are utilized; if the dielectric gel matrix is formulated with an extender such as a microcrystalline polyethylene block co-polymer, or thermoplastic rubber, oils having a molecular weight as low as about 200 may also be used to advantage to give the desired viscosity. Such oils are available from, for instance, Penreco Corp. (i.e., N1500 HT, having a molecular weight of about 520), Shell Corporation (available in several molecular weights, including a molecular weight of 400 which has been utilized to advantage), Amoco (e.g., Amoco 31 having a molecular weight of 400), Exxon (TUFFLO 30 (molecular weight of 460±10) and TUFFLO 50 (molecular weight of 370±10)).

In addition, a corrosion inhibitor and antioxidant are added to the composition of the present invention. Suitable corrosion inhibitors include certain corrosive inhibitors which are typically used in greases which were found to have no effect on the water absorbency or insulation characteristics of the polymer of the gel composition. The rust inhibitor(s) must be chosen with care because those which are of acid character may neutralize the effect of the polymer preferred inhibitors are those sold under the REOMET (Ciba-Geigy Corp.) trademark such as REOMET 39 LF. A neutral barium dinonylnaphthalene sulfonate did not affect the properties of the present invention, but did have a slight tendency to de-gel one of the gel compositions. A copper passivator which is a liquid copper triazole derivative was used without any adverse affects. Many antioxidants are known in the industry; particularly preferred are the antioxidants sold under the trademark IRGANOX (Ciba-Geigy Corp.), but it is not intended that the scope of the invention be restricted only to compositions including that particular antioxidant.

The cable of the present invention is made with conventional cable filling equipment in the manner in which that equipment is utilized to make cable filled with PEPJs and/or ETPRs. Unlike known prior processes for making ETPR and/or PEPJ-filled cable, however, the process is conducted at ambient temperature. Referring to FIG. 1, the process for making a cable 10 involves drawing pairs of wires or conductors 12 through a chamber and die shown generally at 24 in which the gel composition is extruded onto the wires, passing the wires through a sizing insert and then applying a wrapping 16, seen in FIG. 2 to the bundle 14 of coated wires. The wrapped bundle 14 (or several wrapped bundles) is then drawn through a second die 34 in which a second layer of the gel composition is extruded onto the bundles 14 if desired and a sheath or jacket 18 is then applied at station 38.

Figure 2:
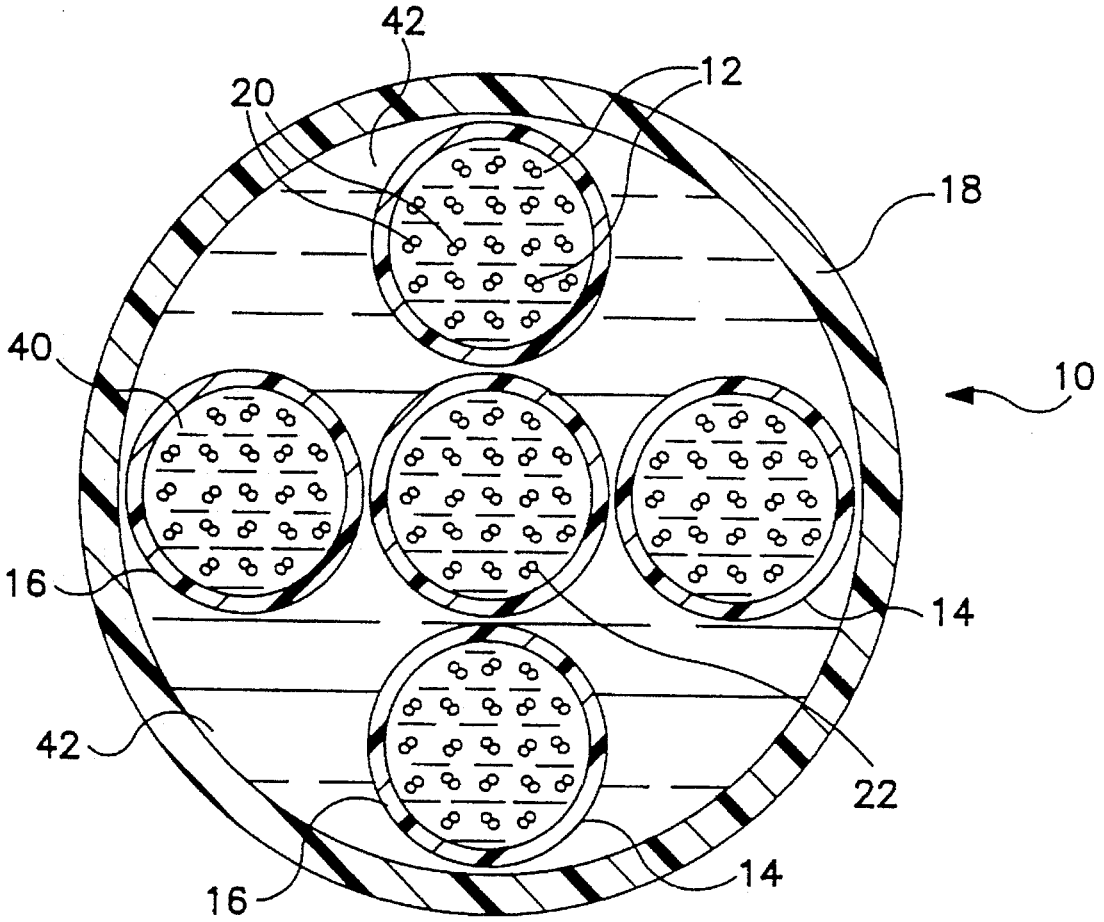
FIG. 2 is a cross-sectional view of a telecommunications cable which includes the composition of the present invention.
Figure 3:
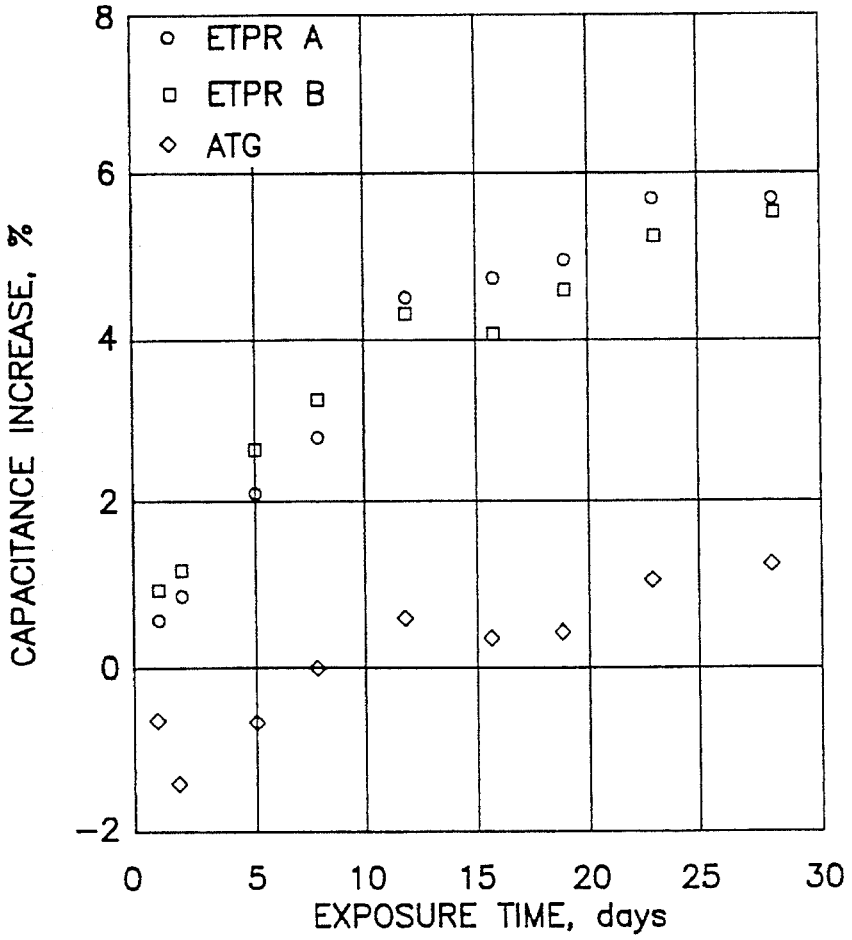
FIG. 3 is a graph representing the capacitance stability of the composition of the present invention as a function of time.
Figure 4:
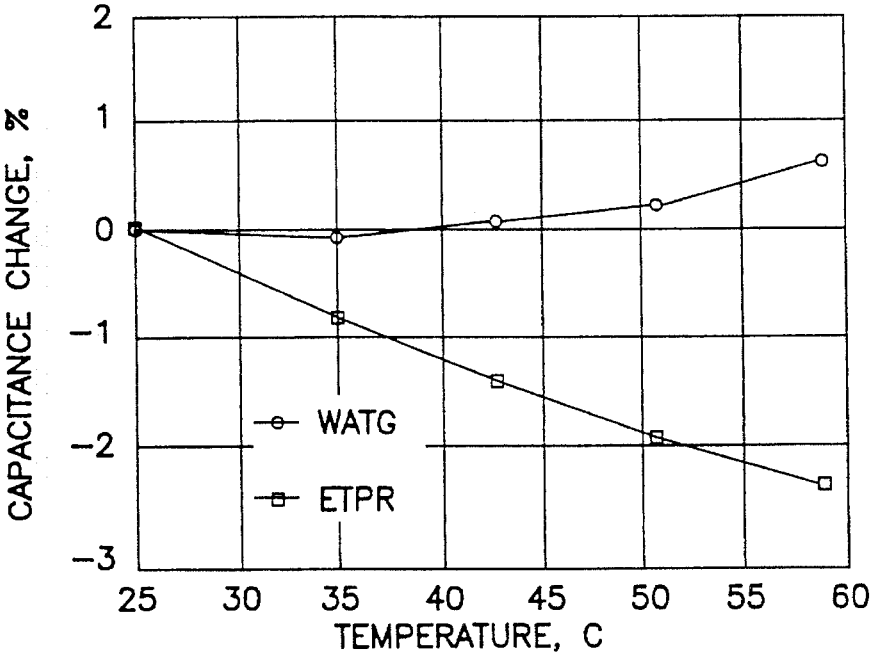
FIG. 4 is a graph representing the capacitance stability of the composition of the present invention as a function of temperature.

A cross-sectional view of a cable 10 made by the process described with reference to FIG. 1 is shown in FIG. 2. Cable 10 has a plurality of paired wires or conductors 12. Each pair of wires 12 is surrounded by a layer of insulation 20. An arbitrary number of pair of wires 12 surrounded by insulation 20 form a bundle 14 within a wrapping 16. Spaces 40 between the pairs of wires 12 inside wrapping 16 of each bundle 14 is filled with the composition of the present invention. Bundles 14 within wrapping 16 are bound into cable 10 by sheath 18, Zone 42 between bundles 14 may also be filled with the composition.

The following are examples of different combinations of gel matrices and mixtures which thicken to produce a gel matrix which is appropriate for use with the water absorbent polymer having pendent anionic groups. The examples of compositions prepared in accordance with the invention are not intended to limit the scope of the invention and are instead illustrative of a number of different compositions which can be used to practice the invention.

EXAMPLE 1

A dielectric oil gel matrix was prepared using 50 parts by weight polyisobutylene (Amoco INDOPOL L-100), 40 parts by weight white oil (Penreco Corp., DRAKEOL 34) and 10 parts by weight of pyrogenic silica (Degussa Corp.). Seventy-five parts of the resulting mixture was blended to 25 parts by weight of the water absorbent polymer in the form of a starch-polyacrylonitrile graft copolymer (WATER LOCK, Grain Processing Corp.). A 12 V battery was hooked up to a pair of spliced wires and water was introduced into the spliced area causing a short. The spliced area was then filled with the composition of Example 1 and water began to be absorbed in about 8 minutes. The short was attenuated and full current flow restored to the cable pair shortly thereafter.

EXAMPLE 2

A gel matrix was prepared using 50 parts by weight polybutylene (Amoco, INDOPOL L-100), 40 parts by weight white oil (Penreco Corp., DRAKEOL 34) and 10 parts by weight pyrogenic silica (Degussa Corp.). Seventy-five parts of the resulting mixture was blended to 25 parts by weight of the water absorbent polymer in the form of a methyacrylamide polymer (sold under the brand name CHEMMUD, Chem-mud, Inc., Leiscester, N.C.). The resulting gel composition, when tested as described in Example 1, began water absorption in about ten minutes, and the short was eliminated shortly thereafter.

EXAMPLE 3

The gel composition for use in the cable of the present invention has also been prepared using white oils of petroleum hydrocarbon stocks of napthenic or paraffinic oils as a dielectric gel matrix. Compositions have been prepared using white oils manufactured by Penreco Corp., including those sold under the brand name DRAKEOL such as DRAKEOL 7, 19, 34, 35 and DRAKEOL 4410, and those manufactured by Witco Corp. and sold under the brand name KAYDOL. The preferred oils for making appropriate dielectric oil gel matrices are those having a viscosity in the range of from about 400 to about 1000.

It has been found that the use of petroleum waxes or low oil cream petrolatums produces a higher viscosity dielectric oil gel matrix, thereby reducing the amount of pyrogenic silica used as a thixotrope as compared to the amounts set forth in the preceding examples. For instance, a composition similar to the composition prepared in Example 1 was prepared substituting a 150 vis waxie hydrated distillate oil (Penreco Corp.) for the polyisobutylene described in that example. The fluid mixture was prepared using 91.8% by weight of the waxie oil, 1.6% polyalkylene glycol (Olin Chemical Corp., POLY-G 9150) and 6.6% microcrystalline wax (Witco Chemical Corp., Witco X-145-A). The dielectric oil gel matrix was prepared by adding 1.0% by weight pyrogenic silica (Degussa Corp.) and 14.7% by weight of high density linear polyethylene powder (Quantum Chemicals Corp., MICROTHENE FA750) to the fluid mixture. To this gel matrix was then added 25.9% by weight of sodium salt of polyacrylic acid (Stockhausen Chemicals Corp., FAVOR C 96) to form a gel composition. When tested in accordance with the procedure described in Example 1, water encapsulation began within five minutes, electrochemical deposition of the polymer insulation began in ten minutes, and the short was healed in twenty minutes.

EXAMPLE 4

The composition of Example 3 was also prepared by substituting a non-hydrated oil for the waxie distillate oil, in particular, Penreco HG Bright Stock Oil, and the addition of 5% Penreco low cream oil petrolatum. When tested in accordance with the above-described procedure, this composition performed in much the same manner as the gel composition of Example 1.

EXAMPLE 5

A dielectric oil gel matrix was prepared using 80 parts by weight white oil (Penreco Corp., DRAKEOL 4410) and 15 parts by weight of a microcrystalline Wax (Witco Corp., X1450A) to 5 parts by weight pyrogenic silica (Degussa Corp.). Eighty parts by weight of the resulting gel matrix was blended with 20 parts by weight of the water absorbent polymer in the form of the sodium salt of a polymer of maleic anhydride obtained from ARCO Chemical which, on information and belief, is a polymer of the type described in U.S. Pat. No. 4,616,063. The resulting gel composition, when tested as described in Example 1, began water absorption in about 10 minutes, and the short was eliminated shortly thereafter. Similar results were obtained using a water absorbent polymer of fumaric anhydride.

EXAMPLE 6

In a presently preferred embodiment, a composition for filling a cable in accordance with the present invention is made in accordance with the following formula (all percentages by weight):

| | |
|---|---|
| base oil (N-1500 HT, Penreco) | 79.2% |
| thixotrope | |
| thermoplastic rubber (KRATON G1701X, Shell Chemicals Corp.) | 1.5% |
| fumed silica (Cab-O-Sil TS720) | 2.0% |
| and Cab-O-Sil M-5, Cabot) | 4.0% |
| polymer (FAVOR 960, Chemische Fabrik Stockhausen GmbH) | 12.0% |
| antioxidant (IRGANOX 1035, Ciba-Geigy Corp.) | 1.3% |

In various formulations, these ingredients have been varied in the following proportions:

| | |
|---|---|
| base oil | 65–82% |
| thixotrope (in various combinations of silica, thermoplastic rubber, and organophilic clay) | 6–14% |
| polymer | 10–20% |
| antioxidant | 0.05–1.5% |

In a particularly preferred embodiment, the polymer is dispersed in the gel matrix, and the gel thickened, by use of hydraulic shear force using a colloid mill in a continuous process for producing the composition. The composition is then used for filling a cable in the manner described above.

EXAMPLE 7

The ability of the filled cable of the present invention to mitigate temperature related changes in capacitance is further illustrated by the following data. An ATG was formulated from the same components and in the same proportions as set out in Example 6 but substituting a FAVOR 944 water absorbing polymer for the FAVOR 960 polymer and utilizing the colloid mill for thickening of the gel. Using 25° C. as the "zero" point, the per cent change in the dielectric constant of the gel was then measured and calculated as follows:

| Temperature (°C.) | % Change in Dielectric Constant |
|---|---|
| −3 | −5.15 |
| 14 | −2.20 |
| 25 | — |
| 35 | 2.59 |
| 45 | 4.26 |
| 55 | 5.18 |
| 60 | 5.69 |

EXAMPLE 8

Electrical performance of the cable of the present invention was tested in the following manner. In a preliminary experiment, twisted pairs of 26 gauge foam-skin insulated wires were immersed in beakers containing the composition made in accordance with Example 6 and two commercially available ETPRs at 60° C. and capacitance measured as a function of time. The results are shown in FIG. 1. As can be seen, the ATG of the present invention was more stable than the ETPRs.

The capacitance of the blue-white pairs of two 25 pair cables with 24 gauge solid insulation, one cable filled with the ATG of Example 6 and the other with a commercially available ETPR, were measured as a function of temperature. The data is shown in FIG. 2. As can be seen, the capacitance of the ETPR filled cable decreases with increasing temperature while that of the ATG-filled cable remains relatively level. The relative stability of the ATG filled cable appears to result from the selection of the water absorbent polymer, the thixotrope, or a combination of polymer and thixotrope which, when used to make the ATG of the present invention, results in an increase in the dielectric constant of the ATG. The temperature-dependent increase in the dielectric constant of the ATG mitigates the decrease in the capacitance of the cable resulting from thermally-induced expansion of the spaces between the wires of the cable. In a preferred embodiment, the polymer, thixotrope, or the combination of thixotrope and polymer, are selected so as to cause an increase in the dielectric constant of the ATG by about 4 to about 6% depending upon the specific polymer and polymer concentration, over a temperature range of about 40° C.

EXAMPLE 9

The ability of the cable of the present invention to meet and/or exceed current requirements for cable electricals was demonstrated in the following manner. Table I contains the electrical data for the 50 pair super-unit of a AFMW 200 cable containing an ATG filling compound manufactured in accordance with Example 6, above. These data are typical of filled cable and fit comfortably within the range required by industry specifications. The value of R/C ratio for the cable was 0.0173 (0.0200 is passing).

TABLE I

| | Average | Std. Dev. | Ind. Max. | Ind. Min. |
|---|---|---|---|---|
| mutual cap. (nF/mile) | 83.53 | 1.37 | 86.30 | 80.99 |
| attenuation (dB/Kf) | 5.30 | 0.04 | 5.41 | 5.21 |

EXAMPLE 10

The resistance of the insulation of the cable of the present invention to the oxidative cracking described above is demonstrated by the following data. Cables filled with the ATG composition of Example 6 were tested for oxidation by aging for various periods and measuring oxidation induction time (OIT). The test instrument was a Perkin-Elmer DSC4 using the Model 3700 Data Station. The test procedure was per Bellcore specification TA-NWT-000421.

In the first test, a 50 pair 24 gauge foam-skin cable filled with an ATG made in accordance with Example 6 was aged for four weeks at 70° C. OIT was determined at 200° C. before and after aging. The type of stabilization package used in the insulation was not known, nor was the cable's prior thermal history. In the second test, three cables, one filled with ATG made in accordance with Example 6 and two with different ETPRs, were evaluated at 200° C. after aging two weeks at 70° C. All three cables were 50 pair, 26 gauge foam-skin insulated conductors. The insulated conductors in all three cables were from the same wire production run. Again, the stabilization packages were not known. The data for both tests are shown in Table II. All values reported represent the average of one run on each of the ten color insulations.

TABLE II

Oxidative Induction Time of Foam-Skin Insulation @ 200° C.

| Filling | Induction Time, min. @ 200° C. | | | |
|---|---|---|---|---|
| | Test #1 4 Weeks Aging @ 70° C. | | Test #2 2 Weeks Aging @ 70° C. | |
| Compound | Av. | Std. Dev. | Av. | Std. Dev. |
| ATG | 53.7 | 7.4 | 64.1 | 4.6 |
| ETPR I | — | — | 53.5 | 8.7 |
| ETPR II | — | — | 46.3 | 6.3 |

Although the invention has been described in terms of a number of examples setting forth preferred embodiments thereof, those skilled in the art who have the benefit of this disclosure will recognize that changes may be made in the compositions described in these various examples without changing the manner in which the various components of the gel composition of the present invention function to accomplish the results achieved by these compositions. Such changes might, for instance, take the form of small variations in the proportions of the various components, the substitution of some substance having a similar function not mentioned in the specification for one of the components of the gel composition, or the addition of a substance to one of the gel compositions described. Such changes are intended to fall within the spirit and scope of the present invention as set out in the following claims.

What is claimed is:

1. A telecommunications cable having relatively stable mutual capacitance comprising a plurality of paired conductors, insulation surrounding each of said paired conductors, and a wrapping around a predetermined number of the insulated, paired conductors to form one or more bundles of said insulated paired conductors, the spaces between the insulated paired conductors in the bundles being filled with a composition having a dielectric constant which increases as the temperature to which the cable is exposed increases, thereby mitigating the decrease in the mutual capacitance of the cable resulting from the expansion effect of increased temperature and of aging on the paired conductors, insulation, and wrapping, the composition being comprised of a dielectric base oil, a water absorbing polymer, and a thixotrope.

2. The telecommunications cable of claim 1 wherein the dielectric constant of the composition increases by up to about 11% as the temperature of the gel increases from −3° to 60° C.

3. The telecommunications cable of claim 1 wherein the dielectric constant of the composition ranges from about 2.2 at 25° C. to about 2.3 at 65° C.

4. The telecommunications cable of claim 1 wherein the composition is formed by mixing about 70 to 85 weight percent dielectric base oil, about 1 to 15 weight percent thixotrope, and about 6 to 20 weight percent water absorbing polymer.

5. The telecommunications cable of claim 1 wherein the molecular weight of the dielectric base oil ranges from about 400 up to about 1000.

6. The telecommunications cable of claim 1 wherein the viscosity of the dielectric base oil ranges from about 1.2 up to about 1.8 million centipoises at 25° C.

7. The telecommunications cable of claim 1 wherein the dielectric base oil is comprised of a hydrocarbon oil having a molecular weight of about 200 or higher and an extender.

8. The telecommunications cable of claim 7 wherein the extender is a block co-polymer, thermoplastic rubber, polyethylene powder, microcrystalline wax, or polyethylene or ethylene microspheres, or mixtures of same.

9. A method of maintaining relatively stable mutual capacitance in a telecommunications cable comprising a plurality of paired conductors surrounded by insulation and a composition in the spaces between the paired insulated conductors comprising the steps of:

exposing the cable to an increase in temperature, thereby causing thermal expansion of the cable with a concomitant decrease in the effective dielectric constant of the cable, and offsetting the thermally-induced decrease in the mutual capacitance of the cable by increasing the dielectric constant of the composition in the spaces between the pairs of insulated wires as temperature increases.

10. The method of claim 9 wherein the dielectric constant of the composition is increased by about 11% as the temperature of the cable is increased from −3° to 60° C.

11. The method of claim 9 wherein the temperature to which the cable is exposed ranges between about −15° to about 60° C.

12. The method of claim 9 wherein the composition is comprised of a dielectric base oil, a thixotrope, and a water absorbing polymer, either the thixotrope or the water absorbing polymer, or the thixotrope and the water absorbing polymer, having been selected so as to cause a temperature-induced increase in the dielectric constant of the composition.

13. A method of making a telecommunications cable having an effective dielectric constant which is a function of temperature and which thereby mitigates temperature induced changes in the mutual capacitance of the cable comprising the steps of:

placing a wrapping around a plurality of insulated paired conductors to form a bundle of said insulated paired conductors;

filling the spaces between insulated paired conductors in the bundle with a composition having a dielectric base oil as one component thereof;

mixing a thixotrope and a water absorbing polymer into the composition before filling the spaces; and selecting the thixotrope or the water absorbing polymer, or both the thixotrope and the water absorbing polymer, so as to cause an increase in the dielectric constant of the composition when the temperature of the composition is increased.

14. The method of claim 13 further comprising forming a plurality of bundles and enclosing the bundles in a sheath.

15. The method of claim 14 wherein the spaces inside the sheath and between the bundles are also filled with the composition.

16. The method of claim 13 wherein the spaces are filled with the composition at ambient temperature.

17. A telecommunications cable capable of being made by the method of claim 13.

* * * * *